US010619640B2

(12) United States Patent
Madsen

(10) Patent No.: US 10,619,640 B2
(45) Date of Patent: Apr. 14, 2020

(54) CENTRIFUGAL PUMP ASSEMBLY

(71) Applicant: Grundfos Holding A/S, Bjerringbro (DK)

(72) Inventor: Christian Madsen, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 273 days.

(21) Appl. No.: 15/700,666

(22) Filed: Sep. 11, 2017

(65) Prior Publication Data

US 2018/0073509 A1 Mar. 15, 2018

(30) Foreign Application Priority Data

Sep. 13, 2016 (EP) ..... 16188626

(51) Int. Cl.

| | |
|---|---|
| ***F04D 15/00*** | (2006.01) |
| ***F04D 9/02*** | (2006.01) |
| ***F04D 27/00*** | (2006.01) |
| ***F04D 27/02*** | (2006.01) |
| ***F04D 9/00*** | (2006.01) |
| ***F04D 13/06*** | (2006.01) |
| *F04D 1/06* | (2006.01) |

(52) U.S. Cl.

CPC ..... *F04D 15/0066* (2013.01); *F04D 9/02* (2013.01); *F04D 15/0011* (2013.01); *F04D 27/009* (2013.01); *F04D 27/0215* (2013.01); *F04D 27/0261* (2013.01); *F04D 1/06* (2013.01); *F04D 9/001* (2013.01); *F04D 9/005* (2013.01); *F04D 9/006* (2013.01); *F04D 13/06* (2013.01)

(58) Field of Classification Search

CPC ..... F04D 9/00; F04D 9/001–005; F04D 9/02; F04D 15/0011; F04D 15/0066; F04D 15/0077; F04D 27/004; F04D 27/009; F04D 27/0261; F04D 27/0207; F04D 27/0215; F04D 27/0223

See application file for complete search history.

(56) References Cited

U.S. PATENT DOCUMENTS 2,395,657 A * 2/1946 Dinsmore ..... G05D 16/2066 417/45
2010/0284826 A1 11/2010 Reid et al.
2013/0336763 A1 12/2013 Lopes et al.

FOREIGN PATENT DOCUMENTS

EP 1 013 936 A1 6/2000
WO 2014/176225 A1 10/2014

* cited by examiner

*Primary Examiner* — Peter J Bertheaud
(74) *Attorney, Agent, or Firm* — McGlew and Tuttle, P.C.

(57) ABSTRACT

A centrifugal pump assembly (2) includes an impeller, an electric drive motor (4), driving the impeller (12), and a back-flow channel (24), forming a flow connection from a delivery side (18) to a suction side (16). A valve (26), in a pressure-dependent manner, closes the flow connection. A control device (28) adjusts/sets the speed (n) of the drive motor (4), and is configured with a venting function for venting the centrifugal pump assembly (2) on operation. According to the venting function, after the detection of an air accumulation, the speed (n) of the drive motor (4) is automatically reduced, and subsequently the speed (n) is rapidly increased again. A method is also provided for removing an air accumulation from a centrifugal pump assembly during operation, which method includes reducing the speed (n) of the centrifugal pump assembly and subsequently rapidly increasing the speed (n) of the centrifugal pump again.

15 Claims, 6 Drawing Sheets

22
32
28
30
10
X
34
4
8
2
18
6
6
6
6
26
I
36
16
20
14

IX
IX
26
24

CENTRIFUGAL PUMP ASSEMBLY

CROSS REFERENCE TO RELATED APPLICATIONS

This application claims the benefit of priority under 35 U.S.C. § 119 of European Application 16 188 626.2 filed, Sep. 13, 2016, the entire contents of which are incorporated herein by reference.

FIELD OF THE INVENTION

The invention relates to a centrifugal pump assembly and in particular to a house water system with such a centrifugal pump assembly.

BACKGROUND OF THE INVENTION

Air bubbles or gas bubbles can accumulate in a pump assembly during operation, with the operation of centrifugal pump assemblies which for example deliver water from a well, as can be the case with house water systems. These accumulations for example can arise due gases dissolved in water being released. If the air or gas accumulations which have formed in the centrifugal pump in this manner become too large, then it can occur that the pump no longer delivers in the desired manner, i.e. that the throughput and pressure build-up are no longer given.

SUMMARY OF THE INVENTION

It is an object of the invention, to create a possibility of being able to remove air or gas accumulations from the centrifugal pump assembly before a failure of the centrifugal pump assembly occurs, and this being the case during operation of the centrifugal pump assembly and, as much as possible, without any functional restriction.

This object is achieved by a centrifugal pump assembly with the features according to the invention, which centrifugal pump assembly comprises at least one impeller which is driven in rotation by an electrical drive motor. For this, the impeller in the known manner can be connected to the rotor of the drive motor via a shaft, or also be fastened directly on the rotor. According to the invention, it is moreover the case of a centrifugal pump assembly which comprises a back-flow channel which represents a flow connection which connects the delivery side of the at least one impeller to its suction side. Such a back-flow channel is provided, so as to design the centrifugal pump assembly in a self-priming manner, which is to say to improve the pump starting characteristics. Thus, on starting operation, fluid can firstly be delivered in the circuit via the back-flow channel, wherein a suction is simultaneously produced in the suction channel of the pump assembly, in order to suck fluid in the suction channel. A valve which closes the back-flow channel or the flow connection created by this, in a pressure-dependent manner, is arranged in the back-flow channel. The valve is configured such that it closes the back-flow channel given a certain pressure at the delivery side of the impeller. This predefined pressure is the pressure which is achieved after venting, when the centrifugal pump assembly goes over into normal operation. The valve is open for as long as the predefined pressure is not reached, and a backflow through the back-flow channel is possible, so that the impeller can firstly deliver a certain share of the flow in the circuit.

The centrifugal pump assembly according to the invention moreover comprises a control unit which is configured for setting and in particular for the (closed-loop) control of the speed of the drive motor. I.e. the speed of the drive motor can be changed via the control device. According to the invention, this control device comprises a venting function which is configured to vent the centrifugal pump assembly on operation, when an undesired gas or air accumulation in the centrifugal pump assembly is ascertained. If such an air accumulation is detected by the control device, which for example can be effected in the manner described below, then the control device preferably automatically starts a venting function, in order to remove the air accumulation out of the centrifugal pump assembly, before the centrifugal pump assembly no longer fulfils its desired function. The control device for this is configured such that after detection of an air accumulation, in a first step (a reducing step), the control device automatically reduces the speed of the drive motor. The speed in this first step can be reduced down to a standstill of the drive motor as the case may be. In a second step (an increasing step), subsequent to this first step, the speed of the motor is increased again, wherein according to the invention, this is effected very rapidly. An intense flow is produced by way of this rapid speed increase, by way of which flow the gas bubbles or the gas accumulations can be flushed out of the centrifugal pump assembly.

The advantage of the venting function according to the invention is that only a brief speed reduction needs to be effected in the first step with this, and the operation of the centrifugal pump assembly is otherwise not compromised, so that a complete pressure drop at the system connecting to the centrifugal pump assembly at the exit side does not occur. This is particularly advantageous with the use of house water systems, since an adequate pressure and also an adequate flow in the water system of the building can always be achieved in this manner. At worst, certain pressure fluctuations occur due to the described speed production and the subsequent rapid speed increase, which however as a rule do not lead to great reductions in the comfort.

The control device is preferably configured in a manner such that in the first step, the speed is reduced to such an extent that the valve in the back-flow channel opens. This has the advantage that the back-flow channel is open with the speed increase in the second step, so that with a rapid speed increase, a flow can be produced in the centrifugal pump assembly via the backflow channel, and this flow entrains the gas accumulation and then flushes it out of the pump assembly. For this, it is necessary for the speed to be increased as rapidly as possible in the second step, in order to achieve the flow build-up before the closure of the valve.

Further preferably, the control device is configured in a manner such that in the second step, the speed is increased to at least 80% of the maximal speed and preferably to the maximal speed. The maximal speed is that speed which is envisaged as the maximum speed for operating the centrifugal pump assembly. One succeeds in an intense flow being produced in the centrifugal pump assembly due to the increase to the maximal speed, in order to flush out the accumulation of air.

The control device is particularly preferably configured in a manner such that in the second step, the speed is increased to the maximum speed in less than three, preferably less than two and further preferably less than 1.5 seconds. On account of this high acceleration, one succeeds in the flow being able to be formed before the valve in the back-flow channel closes. A strong impulse is moreover produced, and this impulse assists the flushing of the gas accumulation out of the centrifugal pump assembly.

According to a further preferred embodiment of the invention, the control device is configured in manner such that it has a monitoring function, so as to recognize the air accumulation. For this, the control device is preferably configured such that an air accumulation is recognized by way of the electrical power consumption falling below a defined first limit value. This is preferably effected at at least one, further preferably at several predefined speeds, for which specific first limit values for the electrical power consumption are defined in the control device. An air accumulation can be recognized by way of the electrical power consumption falling below the associated, set first limit value at the defined speed. The defined speed is particularly preferably the maximal speed. The maximal speed is thereby that speed which is envisaged as the maximal speed for the operation of the centrifugal pump assembly and is maximally set by the control device. The monitoring function, for ascertaining as to whether an air accumulation is present, can be configured in a manner such that the speed is increased to the maximal speed at predefined, in particular regular points in time, in order to carry out a monitoring of air accumulations. Particularly preferably, the examination results automatically at the maximal speed. An air accumulation in the centrifugal pump assembly leads to the pressure difference across the centrifugal pump assembly dropping. The regulation (closed-loop control) in the control device, in as much as a pressure regulation is provided then attempts to compensate this by increasing the speed, until the maximal speed is achieved. The comparison with a predefined limit value for the electrical power consumption is then effected at the maximal speed, in order to ascertain whether an air accumulation is present. However, it is to be understood that this principle can also be applied to speeds other than the maximal speed, and the control device can be configured accordingly.

Further preferably, the control device is configured such that the mentioned first limit value for the electrical power consumption lies above a second limit value for the electrical power consumption, wherein this second limit value is reached or fallen short of with a dry running of the centrifugal pump assembly. The second limit value thus signals the dry running of the centrifugal pump assembly. It is possible to differentiate the air accumulation which is to be removed, from a complete dry running, due to the fact that the first and the second limit value are different. The control device is further preferably configured such that its puts the centrifugal pump assembly out of operation, i.e. switches of the drive motor, on falling short of the second limit value, in the case of a dry running, in order in particular to avoid bearing damage.

The centrifugal pump assembly according to a further preferred embodiment is configured such that the rotation axis of the drive motor and of the at least one impeller extends horizontally. Thereby, the horizontal extension relates to the envisaged operational position of the centrifugal pump assembly, in which the centrifugal pump assembly is to be set up for operation. It is indeed with centrifugal pump assemblies with a horizontal rotation axis that the problem of air being able to accumulate in the upper regions in the inside of the casing of the centrifugal pump assembly and in the impeller occurs. The accumulating air cannot rise freely upwards and escape from the inside of the centrifugal pump assembly on its own accord, if the flow paths in the inside of the centrifugal pump assembly likewise extend in the horizontal direction, as is usually the case with multi-stage pumps.

The centrifugal pump assembly can preferably be configured in a multi-staged manner with at least two impellers which are preferably driven by a common shaft. The impellers are connected in series such that the delivery side of the first impeller is connected to the suction side of the second impeller, so that, starting from the exit pressure at the delivery side of the first impeller, a second pressure increase is effected by the second impeller.

If the centrifugal pump assembly is configured in a multi-stage manner, then the back-flow channel preferably extends such that the delivery side of one of the impellers, preferably the delivery side of the impeller which is last on the flow direction, is connected to the suction side of the first impeller by way of the back-flow channel. Alternatively, it is also possible for the backflow channel to branch between two stages and thus for example connects the delivery side of the first impeller to the suction side of the first impeller. The circuit to be built up for starting operation is thus shortened.

The subject-matter of the invention, apart from the previously described centrifugal pump assembly, is a house water system with a centrifugal pump assembly according to the preceding description. House water systems serve for the supply of a building with water, in particular drinking water or to increase the pressure in the water supply of a building. A house water system for example can deliver water into the building from a well. Such house water systems apart from the pump assembly as a rule comprise a pressure accumulator, in order to be able to maintain a certain operating pressure in the system, even when the centrifugal pump assembly is switched off. Such a house water system can moreover comprise a flow sensor and/or pressure switch which are connected to the control device such that the control device can detect a water requirement by way of the detected readings, and can switch on the centrifugal pump assembly, i.e. its drive motor, when the pressure at the exit side of the centrifugal pump assembly drops below a predefined limit value. The control device is preferably integrated with the remaining components of the house water system into a construction unit, i.e. preferably arranged in an electronics housing which is integrated directly into the house water system, for example attached on the motor casing of the drive motor. An electronics housing with the control device can alternatively also be arranged externally and distanced to the drive motor and be connected to this for example via a cable connection. The house water system particularly preferably forms a construction unit which only needs to be connected to a pressure conduit and to an electricity supply, at the exit side of the centrifugal pump assembly, by way of a suction conduit and connection lead respectively. The centrifugal pump assembly of the house water system is preferably configured according to one or more of the previously described, preferred embodiments.

The subject-matter of the invention is moreover a method for removing an air accumulation from a centrifugal pump assembly during operation of the centrifugal pump assembly, i.e. after starting operation of the centrifugal pump assembly. The method according to the invention comprises at least the following steps: in a first step, the speed of the centrifugal pump assembly is reduced after recognizing an air accumulation. The speed of the centrifugal pump assembly in a subsequent second step is subsequently rapidly increased again. A strong flow in the inside of the centrifugal pump assembly is produced by way of this, and the air accumulation can be flushed out of the centrifugal pump assembly by way of this flow.

According to a preferred embodiment of the invention, the speed in the first step is preferably reduced to such an extent that a valve in the back-flow channel between the delivery side and the suction side of the centrifugal pump assembly or between the delivery side and suction side of at least one stage of the centrifugal pump assembly and which closes in a pressure-dependent manner opens. The above description with respect to the centrifugal pump assembly is referred to inasmuch as this is concerned.

Further preferably, in the second step, the speed of the centrifugal pump assembly is increased to the maximum speed, i.e. the maximally envisaged operating speed of the centrifugal pump assembly. This encourages the production of a sufficiently strong flow for flushing out the air accumulation.

Particularly preferably, the speed in the second step is increased to the maximal speed in less than three seconds, preferably in less than two seconds, and further preferably in less than 1.5 seconds. One can succeed in an intense flow being formed, before the valve in the described back-flow channel closes, on account of this. Hence, an intense flow through the back-flow channel is produced, by way of which the air can be flushed out of the centrifugal pump assembly.

According to a further variant of the method, this moreover has a function of recognizing the air accumulation to be removed, during operation. This is effected in a manner such the electrical power consumption at a certain speed and preferably at maximal speed, is compared to a predefined limit value. If the electrical power consumption drops below this predefined limit value, then this is an indication that an undesirable quantity of air or gas has accumulated in the centrifugal pump assembly, i.e. in particular in one or more impellers of the centrifugal pump assembly. As described above, this limit value is preferably selected in a manner such that it lies above the limit value for the electrical power consumption, said limit value signalising a dry running of the centrifugal pump assembly. An air accumulation can hence be differentiated from a complete dry running.

The described method is particularly preferably applied together with the centrifugal pump assembly described above or with the house water system described above. The preceding description of the centrifugal pump assembly, with which likewise preferred method features have been described, is referred to with regard to preferred embodiments of the method.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2:
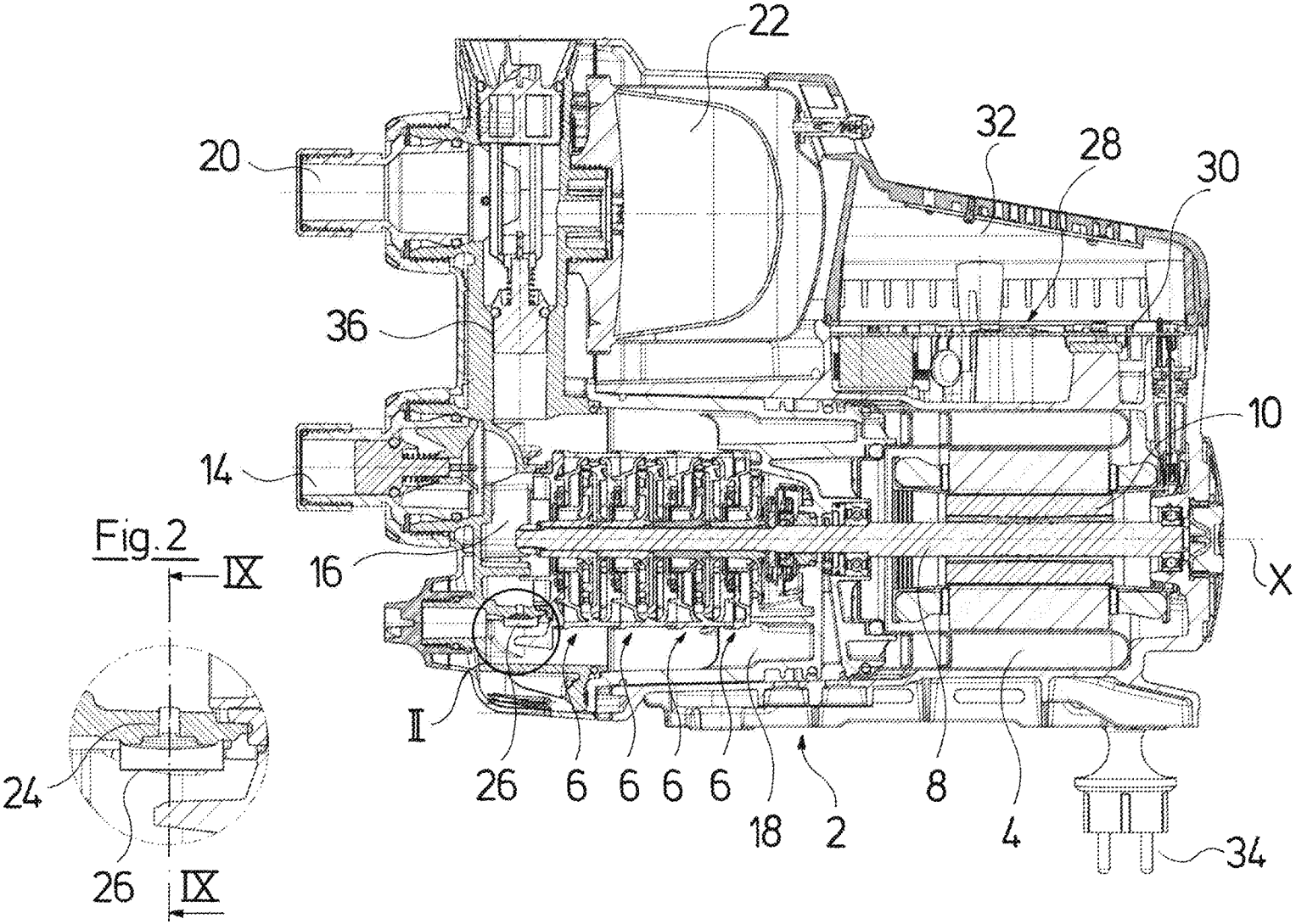
FIG. 1 is a sectioned view of a house water system according to the invention, with a centrifugal pump assembly according to the invention.
FIG. 2 is an in an enlarged view showing detail II of FIG. 1.

Referring to the drawings, the house water system according to FIG. 1 comprises a centrifugal pump assembly 2 which has an electric drive motor 4 as well as four pump stages 6, said pump stages being connected to the rotor 10 of the electric drive motor 4 via a common shaft 8. Each of the pump stages 6 comprises an impeller 12 which is arranged on the shaft 8 in a rotationally fixed manner.

FIG. 1 shows the envisaged operational position of the centrifugal pump assembly 2, according to which the rotation axis x of the shaft 8 extends horizontally.

Diffusers are arranged between the impellers of the individual pump stages in the known manner. The flow direction through the four pump stages 6 is from the left to the right in FIG. 1. The first impeller 12 which is distanced furthest from the drive motor 4 is the entry-side impeller and is in connection with the suction connection 14 via a suction channel 16. The impeller 12 which is situated closest to the drive motor 4 forms the impeller 12 which is last in the flow direction. The flow path at the exit side of the last impeller 12 runs out into an annular channel 18 which surrounds the pump stages 6 and which forms a delivery channel. This delivery channel is connected to the delivery connection 20 of the house water system. A pressure accumulator 22 which is connected to the delivery channel between the annular channel 18 and the delivery connection 20 is moreover integrated into the house water system.

Figure 9:
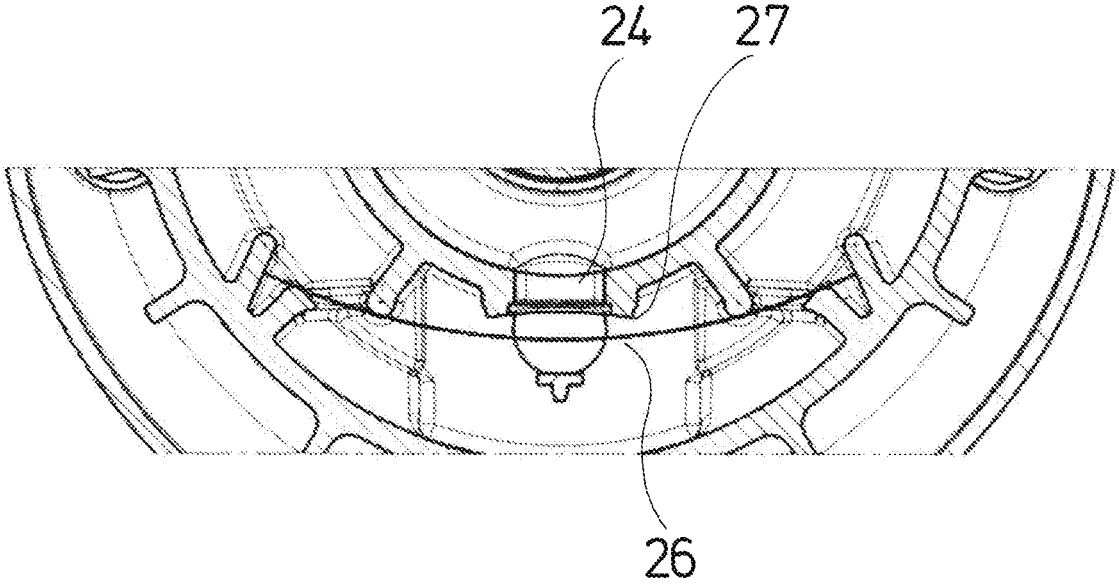
FIG. 9 is a sectioned view along the line IX-IX in FIG. 2.

A backflow channel 24 which forms a flow path from the delivery side to the suction side of the centrifugal pump assembly is formed between the annular channel 18 and the suction channel 16. A spring-biased valve 26 (see FIGS. 2 and 9) which can close the backflow channel in a pressure-dependent manner is arranged in this backflow channel 24. The valve 26 is configured as a strip-like or leaf-like spring which is impinged by the pressure in the annular channel 18, and with a sufficient pressure is pressed against a valve seat 27 surrounding the backflow channel 24 at its end which faces the annular channel 18. The valve 26 is configured such that it closes above a predefined pressure difference between the suction channel 16 and the annular channel 18, and opens below this predefined pressure difference, by way of it coming into contact on the valve seat 27 or disengaging from the valve seat 27. On starting operation of the centrifugal pump assembly 2, an adequate pressure is still not yet present at the delivery side, so that the pressure difference between the suction channel 16 and the annular channel 18 is firstly essentially zero or very low. In this condition, firstly a certain fluid quantity is delivered by the pump stages 6 via the backflow channel 24 into the circuit, in order to achieve a first pressure build-up in the annular channel 18 and thus a suction in the suction channel 16 and at the suction connection 14. The priming of the pump assembly, in particular a self-priming is assisted by way of this. If an adequately high pressure is formed in the annular channel 18, then the valve 26 closes the backflow channel 24, and the centrifugal pump assembly 2 goes over into normal operation, i.e. the fluid which exits out of the fourth and the last pump stage 6 is delivered to the delivery connection 20 in a complete manner, and, as the case may be, into the pressure accumulator 22.

The house water system and its centrifugal pump assembly 2 moreover comprise an electronic control device 28, whose electronic components are arranged on at least one circuit board 30 in electronics housing 32. The control device 28 serves for the activation of the drive motor 4, in particular for the speed regulation of the drive motor 4. The control device 28 can comprise a frequency converter for this, via which frequency converter the speed of the drive motor 4 can be changed.

The house water system which is represented in FIG. 1 forms an integrated construction unit which encompasses the centrifugal pump assembly 2 with the electronics housing 32 and the control device 28 which is arranged therein, as well as the pressure accumulator 22, which is to say integrates these into a housing/casing. This integrated construction unit has essentially three connections, specifically the suction connection 14 and the delivery connection 20 as hydraulic connections, as well as an electrical connection 34 for energy supply.

Apart from the venting on starting operation of the centrifugal pump assembly, the problem of gas bubbles being able to accumulate in the pump stages 6 and in particular in the first pump stage 6 occurs on operation. The control device 28 for this is provided with a venting function which serves for the removal of these gas bubbles out of the pump stages 6 and thus out of the complete centrifugal pump assembly 2, on running operation and essentially without compromising the functioning. This venting function is described in more detail by way of FIGS. 3-7.

Figure 3:
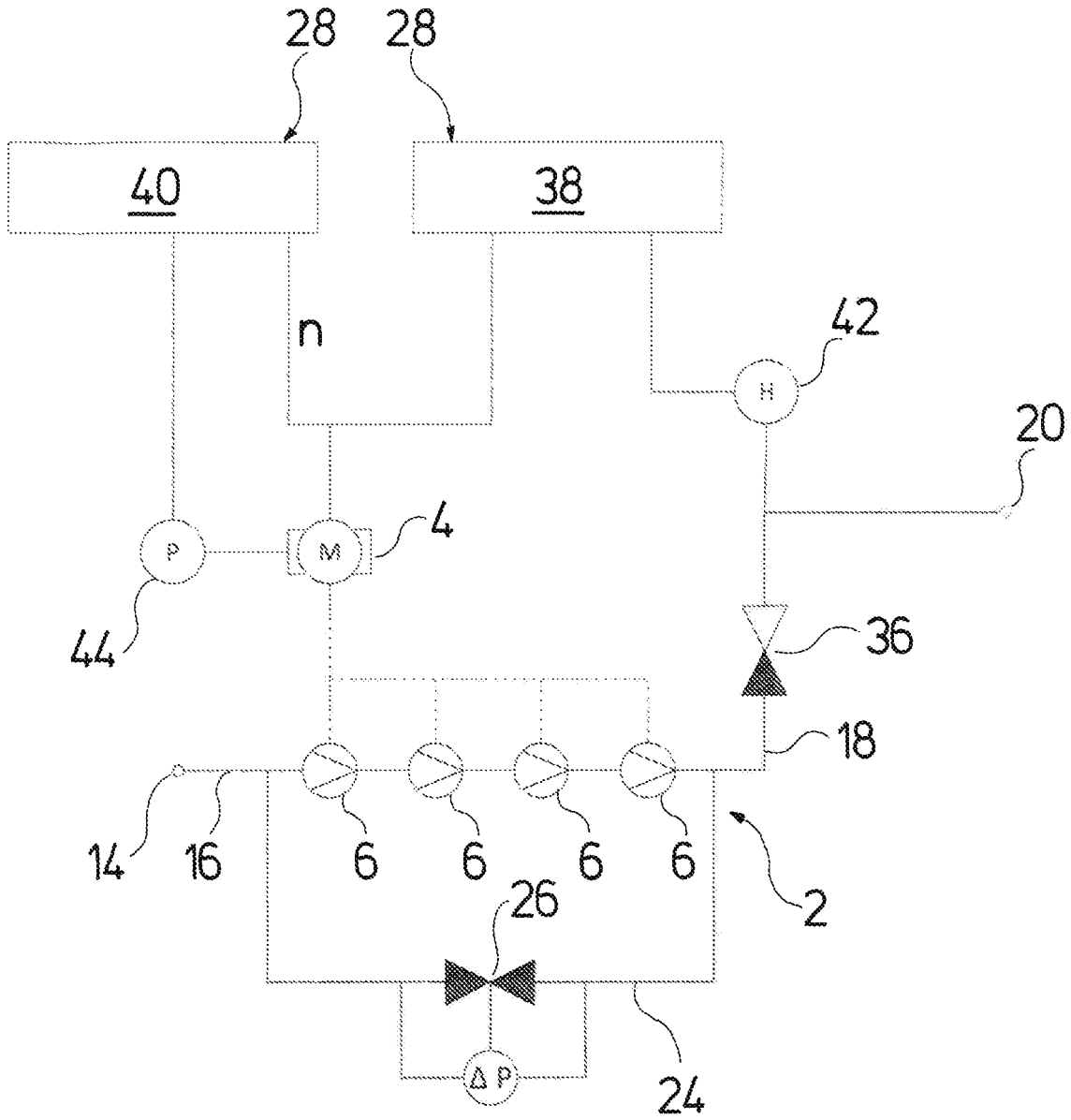
FIG. 3 is a connection diagram of the centrifugal pump assembly according to FIG. 1.

FIG. 3 in a schematic manner and in a connection diagram shows the construction of the house water system according to FIG. 1. The electric drive motor 4 can be recognized and this drives the four pump stages 6 which is to say the impellers 12 of these pump stages 6, in a successive manner in the flow direction. The pump stage 6 which is the first at the suction side is in connection with the suction connection 14 via the suction channel 16, whereas the pump stage 6 which is last in the flow direction runs out into the delivery channel 18 which is formed by the annular channel 18. This delivery channel in turn leads to the delivery connection 20 and is in connection with the pressure accumulator 22 which is not shown in FIG. 3. A check valve 36 is arranged in the delivery channel 18. The backflow channel 24 with the valve 26 which is arranged therein and which opens and closes in dependence on the pressure difference ΔP moreover leads from the delivery channel 18 to the suction channel 16. The valve is shown in the closed condition in FIG. 3.

The control device 28 which activates the electrical drive motor 4, considered schematically, comprises essentially two constituents, specifically on the one hand a control unit 38 and on the other hand a detection unit 40. The control unit 38 in the conventional manner serves for the speed control of the drive motor 4. For this, the control unit 38 is connected to a pressure sensor 42 which detects the pressure H at the exit side of the house water system, i.e. in the delivery channel 18 and at the delivery connection 20. The control unit 38 can maintain the pressure H at the delivery connection 20 in a desired, predefined value range by way of adjusting/setting the speed of the electrical drive motor 4.

The detection device 40 serves for detecting undesirable gas accumulations or air accumulations in the pump stages 6, and in cooperation with the control unit 38, for providing the mentioned venting function. The detector unit 40 is connected to a power detection device 44, in order to detect the electrical power consumption or uptake P of the drive motor 4. The detection device 40 simultaneously via the control unit 38 acquires the speed n of the drive motor 4.

Figure 4:
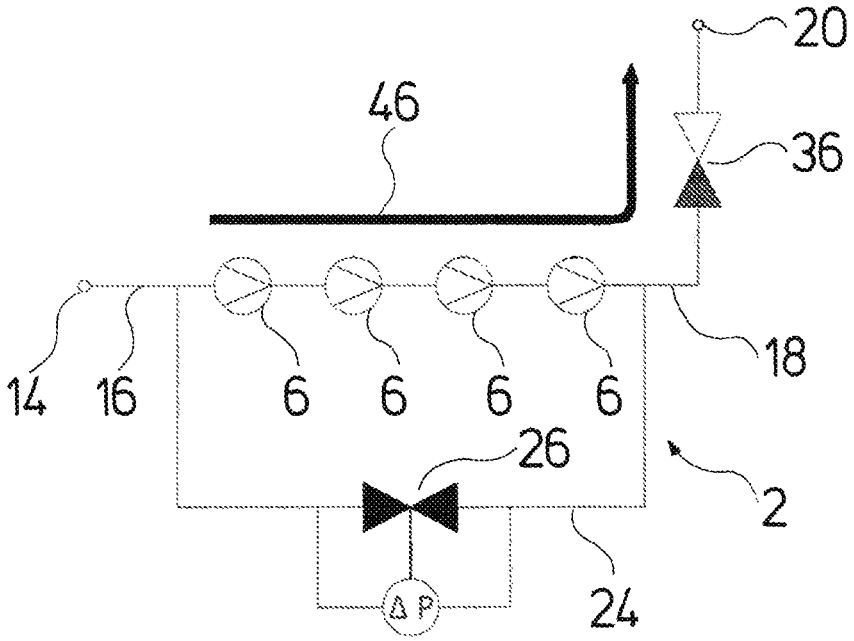
FIG. 4 is a connection diagram according to FIG. 3, in the condition of an air accumulation in the first stage of the centrifugal pump assembly.

The recognition of a gas accumulation is effected in the following manner. On operation, the pump assembly 2 via the pump stages 6, as is shown in FIG. 4, delivers a fluid flow 46 from the suction connection 14 to the delivery connection 20. Thereby, a gas accumulation can form on operation, in particular in the first pump stage 6. If the centrifugal pump assembly 2 is now operated at the maximally envisaged speed n, then this gas accumulation leads to the power of the pump assembly reducing and the electrical power consumption P also dropping.

Figure 8:
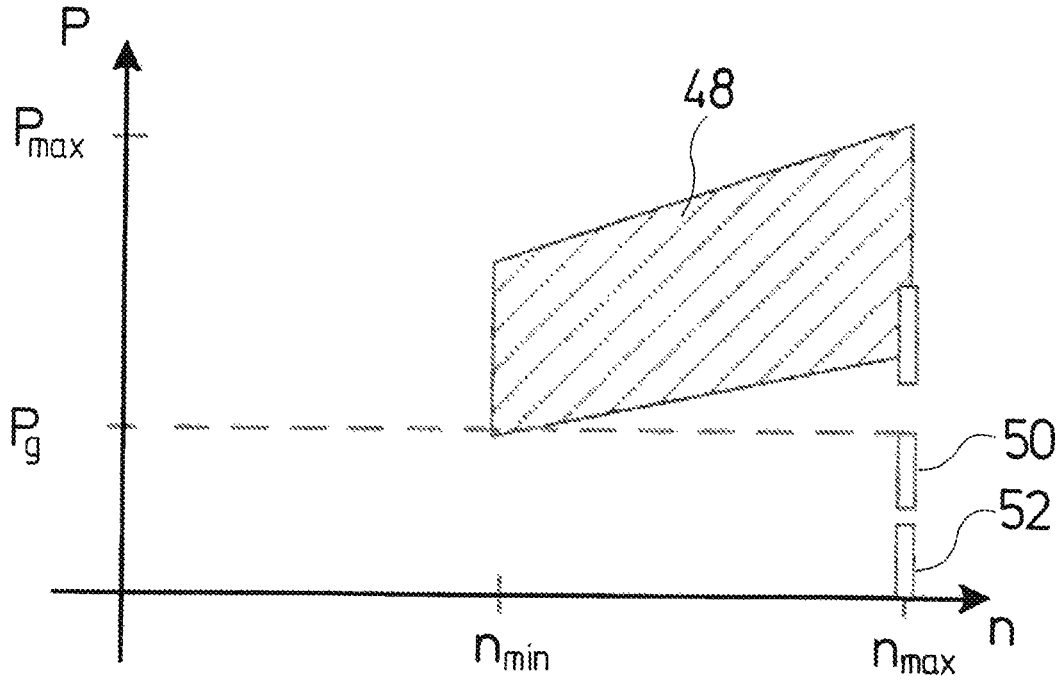
FIG. 8 is a graph showing the working regions of the centrifugal pump assembly according to the invention, in a representation of the electrical power against speed.

This is represented schematically in FIG. 8. The field 48 in FIG. 8, in which the electrical power consumption P is plotted against speed n, represents the region of normal operation. The normal operation 48 runs between a minimal speed $n_{min}$ and a maximal speed $n_{max}$. Thereby, the electrical power consumption P lies between a lower limit $P_g$ and a maximal power consumption $P_{max}$. With regard to the lower limit $P_g$, it is the case of a predefined limit value, on falling short of which the detection unit 40 detects a gas accumulation. This is effected at maximal speed $n_{max}$. If a gas accumulation forms in the pump assembly, this leads to the dropping of the exit pressure H or the differential pressure across the pump assembly. If, as described above, a regulation (closed-loop control) of the pressure H at the delivery connection 20 is carried out in the control unit 38, then this control unit 38 increases the speed of the drive motor 4, in order to increase the pressure. When the maximal speed $n_{max}$ is finally achieved with this, a comparison with the limit value $P_g$ for the electrical power consumption P can take place at this speed in the previously described manner. Alternatively, the speed could be increased to the value $n_{max}$ at certain points in time, preferably at regular points in time, by the detection unit 40 via the control unit 38. Moreover, it would also be possible to carry out a comparison with predefined limit values for the electrical power consumption P at other predefined speeds. With other speeds too, the electrical power consumption P drops below an associated predefined limit value in the case of an air accumulation. Below the limit value $P_g$, two operating conditions 50 and 52 can be differentiated given a maximal speed $n_{max}$, wherein the operating condition 50 represents an operating condition, in which a gas accumulation is present in the pump stages 6, and the operating condition 52 represents the dry running. With the dry running, the electrical power consumption P is even less, so that this can also be detected by the detection unit 40, and the electrical drive motor 4 can be switched off via the control unit 38 for example.

Figure 5:
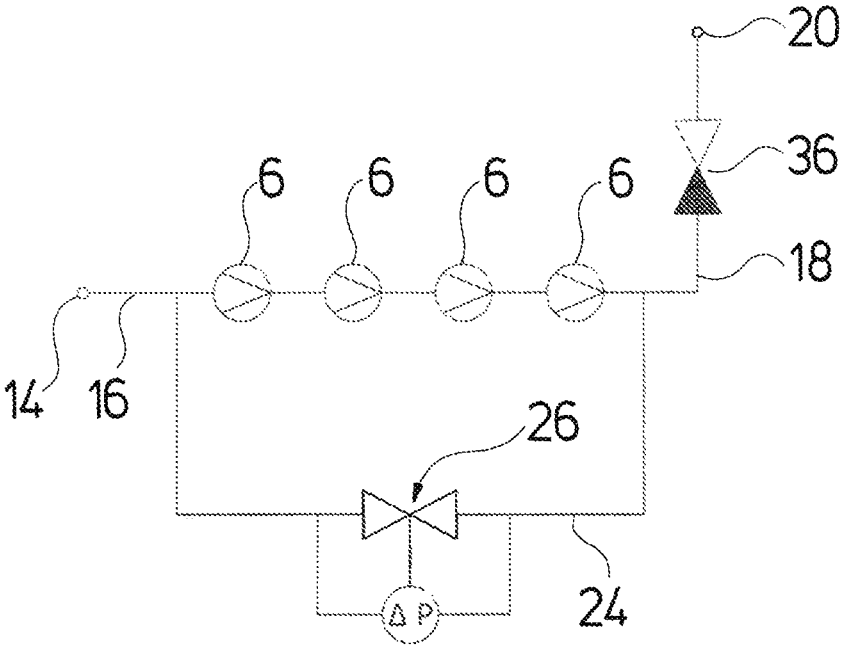
FIG. 5 is a connection diagram according to FIG. 4, with the reduction of the speed.
Figure 6:
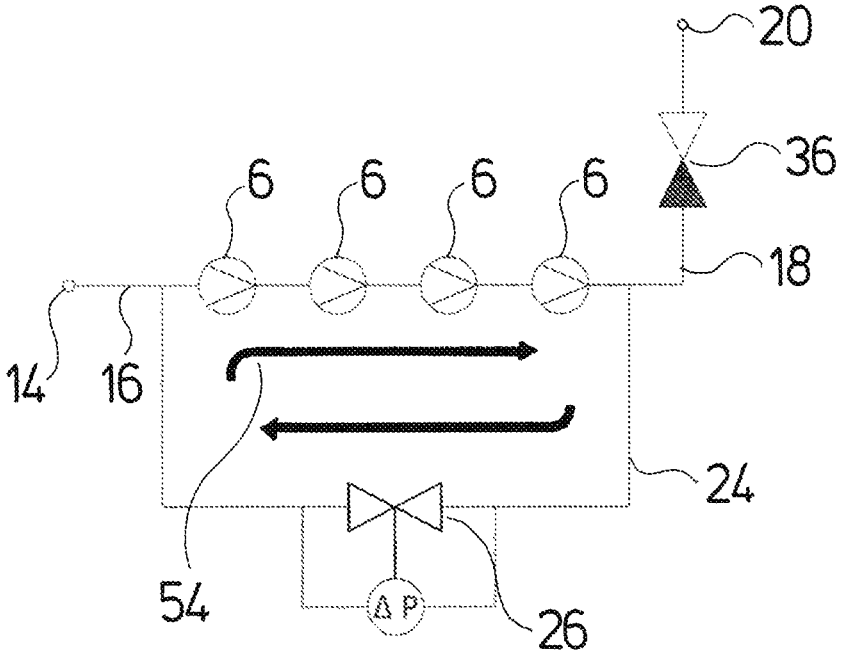
FIG. 6 is a connection diagram according to FIG. 5, with a renewed increase of the speed.
Figure 7:
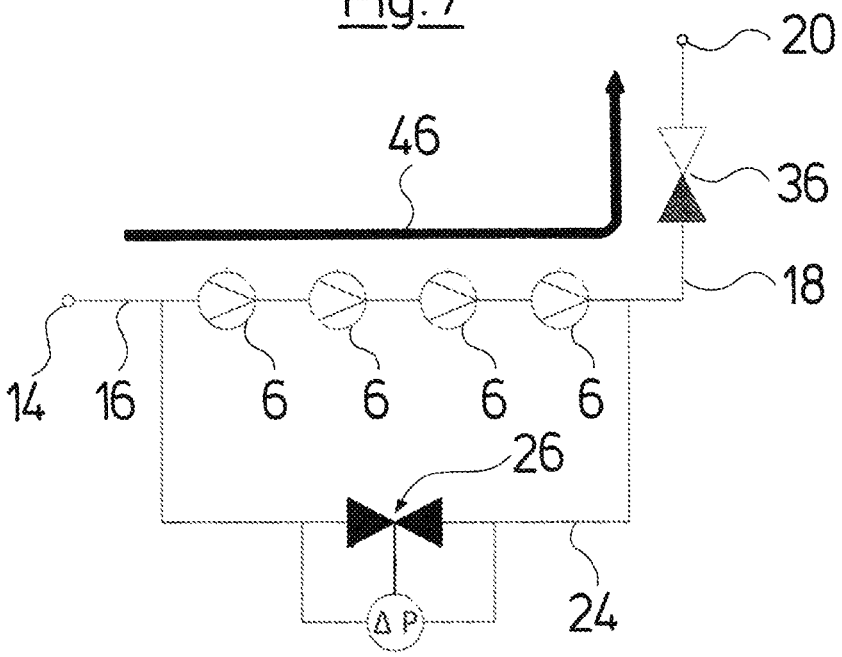
FIG. 7 is a connection diagram according to FIG. 6, with a further operation of the pump assembly.

If a gas or air accumulation is detected in the described manner, then the control device 28 starts a venting function. According to this venting function, firstly the speed n of the drive motor 4 is reduced by the control device 38 to such an extent, that the pressure difference ΔP across the valve 26 reduces to such an extent that the valve 26 opens. As the case may be, the electrical drive motor 4 for this must be stopped by reducing the speed n to zero. This condition is represented in FIG. 5. In this condition, only a small or even no delivery flow exists, wherein this can be briefly compensated by the pressure accumulator 22, so that a complete pressure drop does not occur at the exit side of the delivery connection 20. Departing from this condition, the speed n of the drive motor 4 is increased very rapidly again by the control device 28, preferably in less than three or less than 2 seconds, to the maximal speed $n_{max}$. This condition is represented in FIG. 6. In this condition, the valve 26 firstly remains opened due to the inertia and the initially still low pressure difference ΔP. A circulating flow 54 of a mixture of water and gas or air through the pump stages 6 and the backflow channel 24 arises by way of this. The air accumulation firstly distributes in the circulating flow 54 due to this. The circulating flow 54 is abruptly prevented when the valve 26 closes again due to the increasing pressure difference ΔP, as shown in FIG. 7, and the normal fluid flow 46 from the suction channel 16 through the four pump stages 6 into the delivery channel 18 sets in, wherein the gas bubbles which are now dispersed are entrained in this delivery channel and are flushed out of the delivery connection 20 via the check valve 36. The check valve 36 does not open until a sufficiently high pressure is built up in the delivery channel 18. The check valve 36 otherwise firstly remains closed due to the pressure in the conduit connecting to the delivery connection 20 and in the pressure accumulator. This is particularly the case at the beginning of the flow build-up, which was described by way of FIG. 6, i.e. with the rapid speed increase of the drive motor 4.

The early detection of gas accumulations in the centrifugal pump assembly and according to the invention prevents the centrifugal pump assembly from reaching a condition, in which an adequate pressure build-up and adequate delivery flow is no longer given due to the gas or air accumulation. In contrast, one can ensure at an early stage that the gas accumulations are removed from the pump stages 6 by way of activating the venting function. Thereby, the operation is compromised to an insignificant extent, since the speed of the drive motor 4 only needs to be reduced briefly, or the drive motor 4 only needs to be switched off briefly. Brief pressure peaks possibly occur due to the rapid speed increase, but these as a whole lead to an insignificant reduction of the comfort.

It is to be understood that the venting function can also be carried out independently of the described recognition of gas bubbles. The venting function could therefore also be started at certain, in particular regular time intervals if gas accumulations are suspected. Another type of detection of the gas accumulations is also possible.

While specific embodiments of the invention have been shown and described in detail to illustrate the application of the principles of the invention, it will be understood that the invention may be embodied otherwise without departing from such principles.

What is claimed is:

1. A centrifugal pump assembly comprising:

at least one impeller;

an electric drive motor driving the impeller;

a back-flow channel forming a flow connection from a delivery side of the impeller to a suction side of the impeller;

a valve closing, in a pressure-dependent manner, the flow connection; and a control device setting a speed of the drive motor, said control device being further configured, after a detection of an air accumulation by way of the control device, to automatically reduce the speed of the drive motor and subsequently rapidly increase the speed of the drive motor again.

2. A centrifugal pump assembly according to claim 1, wherein the control device is further configured such that the speed of the drive motor is reduced to such an extent that the valve of the back-flow channel opens.

3. A centrifugal pump assembly according to claim 1, wherein the control device is further configured such that the speed of the drive motor is increased to a maximal speed.

4. A centrifugal pump assembly according to claim 1, wherein the control device is further configured such that the speed of the drive motor is increased to a maximum speed in less than three seconds.

5. A centrifugal pump assembly according to claim 1, wherein the control device detects the air accumulation based on the control device further having a monitoring function to recognize an air accumulation by way of electrical power consumption falling below a defined first limit valve at a certain speed.

6. A centrifugal pump assembly according to claim 5, wherein the control device is configured such that the first limit value for the electrical power consumption lies above a second limit value for the electrical power consumption, wherein said second limit value signals a dry running of the centrifugal pump assembly.

7. A centrifugal pump assembly according to claim 1, wherein a rotation axis of the drive motor and of the at least one impeller extends horizontally in a defined operational position.

8. A centrifugal pump assembly according to claim 1, further comprising at least another impeller and a common shaft, wherein the centrifugal pump assembly is configured as a multi-stage pump with at least two impellers which are driven by the common shaft.

9. A centrifugal pump assembly according to claim 8, wherein the back-flow channel connects the delivery side of one of the impellers, which is last in the flow direction, to the suction side of a first of the impellers.

10. A house water system for delivery or pressure increase or both delivery and pressure increase in a water supply, the house water system comprising a centrifugal pump assembly comprising:

at least one impeller;

an electric drive motor driving the impeller;

a back-flow channel forming a flow connection from a delivery side of the impeller to a suction side of the impeller;

a valve closing, in a pressure-dependent manner, the flow connection; and a control device setting a speed of the drive motor, said control device being further configured, after a detection of an air accumulation by way of the control device, to automatically reduce the speed of the drive motor and subsequently rapidly increase the speed of the drive motor again.

11. A method for removing an air accumulation from a centrifugal pump assembly comprising at least one impeller, an electric drive motor driving the impeller, a back-flow channel forming a flow connection from a delivery side of the impeller to a suction side of the impeller, a valve in the back-flow channel closing, in a pressure-dependent manner, the flow connection and a control device setting a speed of the drive motor during operation thereof, the method comprising the steps of:

in a reducing step, reducing a speed of the drive motor of the centrifugal pump assembly, wherein the speed of the drive motor, in the reducing step, is reduced to such an extent that the valve in the back-flow channel between the delivery side and the suction side of the centrifugal pump assembly opens; and subsequently, in an increasing step, rapidly increasing the speed of the drive motor of the centrifugal pump assembly.

12. A method according to claim 11, wherein in the increasing step, the speed of the drive motor of the centrifugal pump assembly is increased to the maximal speed.

13. A method according to claim 11, wherein the speed of the drive motor, in the increasing step, is increased to the maximal speed in less than three seconds.

14. A method according to claim 11, wherein the air accumulation in the centrifugal pump assembly, which is to be removed, is recognized by way of electrical power consumption falling below a defined limit value at a certain speed.

15. A method for removing an air accumulation from a centrifugal pump assembly comprising at least one impeller, an electric drive motor driving the impeller, a back-flow channel forming a flow connection from a delivery side of the impeller to a suction side of the impeller, a valve closing, in a pressure-dependent manner, the flow connection, and a control device setting a speed of the drive motor during operation thereof, the method comprising the steps of:

in a reducing step, reducing a speed of the drive motor of the centrifugal pump assembly; and subsequently, in an increasing step, rapidly increasing the speed of the drive motor of the centrifugal pump assembly;

wherein the air accumulation in the centrifugal pump assembly, which is to be removed, is recognized by way of electrical power consumption falling below a defined limit value at a certain speed.

* * * * *